United States Patent [19]

Eckenrod et al.

[11] Patent Number: 4,784,828

[45] Date of Patent: Nov. 15, 1988

[54] LOW CARBON PLUS NITROGEN, FREE-MACHINING AUSTENITIC STAINLESS STEEL

[75] Inventors: John J. Eckenrod, Coraopolis; Geoffrey O. Rhodes, Saxonburg; Kenneth E. Pinnow, Pittsburgh, all of Pa.; William E. Royer, Lafayette, N.Y.

[73] Assignee: Crucible Materials Corporation, Pittsburgh, Pa.

[21] Appl. No.: 898,488

[22] Filed: Aug. 21, 1986

[51] Int. Cl.[4] ..... C22C 38/40; C22C 38/60

[52] U.S. Cl. ..... 420/42; 420/43; 420/49

[58] Field of Search ..... 420/42, 43, 49

[56] References Cited

U.S. PATENT DOCUMENTS 4,613,367 9/1986 Eckenrod et al. ..... 420/44

FOREIGN PATENT DOCUMENTS 0161819 9/1952 Australia ..... 420/42
56-47553 4/1981 Japan ..... 420/42
56-90959 7/1981 Japan ..... 420/42
2114155 8/1983 United Kingdom ..... 420/42

*Primary Examiner*—Deborah Yee
*Attorney, Agent, or Firm*—Finnegan, Henderson, Farabow, Garrett & Dunner

[57] ABSTRACT

A resulfurized, chromium-nickel austenitic stainless steel having improved machinability resulting from low carbon and low nitrogen contents in combination with manganese and sulfur additions. The composition of the steel consists essentially of, in weight percent, carbon plus nitrogen total up to 0.065, preferably up to 0.040 or 0.056, chromium 16 to 30, preferably 17 to 19, nickel 5 to 26, preferably 6 to 14, sulfur 0.10 to 0.45, preferably 0.10 to 0.25, more preferably 0.25 to 0.45, manganese 0.75 to 2.0, silicon up to 1, phosphorus up to about 0.20, molybdenum up to 1.0 and copper up to 1.00, and balance iron and incidental impurities.

11 Claims, No Drawings

LOW CARBON PLUS NITROGEN, FREE-MACHINING AUSTENITIC STAINLESS STEEL

BACKGROUND OF THE INVENTION

The present invention relates to a resulfurized, chromium-nickel austenitic stainless steel having improved free-machining characteristics. Austenitic stainless steels are used in a variety of fabricating and finishing operations, many of which include machining. Consequently, the machinability of the steel, especially for bar products, is an important characteristic.

It is known that elements such as sulfur, selenium, tellurium, bismuth, lead, and phosphorus when added to austenitic stainless steels result in improved machinability. It is also known that by maintaining relatively high manganese-to-sulfur ratios in austenitic stainless steels machinability may be further enhanced. Improved machinability results with high manganese-to-sulfur ratios by the formation of relatively soft manganese-rich sulfides. The extent to which machinability may be improved by the addition of manganese and sulfur is limited because at sulfur contents in excess of about 0.45%, the corrosion resistance of the steel is adversely affected and the appearance of the resulting machined surface is often degraded.

OBJECTS OF THE INVENTION

It is accordingly a primary objective of the present invention to provide an austenitic stainless steel having machinability characteristics exceeding those obtained solely by the use of manganese and sulfur at the levels conventionally employed for this purpose.

It is a more specific object of the invention to provide a resulfurized, chromium-nickel free-machining austenitic stainless steel wherein carbon and nitrogen, in combination, are maintained at much lower than conventional levels.

SUMMARY OF THE INVENTION

Broadly, in accordance with the invention, the machinability of an austenitic stainless steel is improved by employing very low carbon plus nitrogen contents in combination with manganese and sulfur additions. It is to be understood that for purposes of further improvement in machinability that the elements conventionally used for this purpose, which in addition to sulfur include selenium, tellurium, bismuth, lead, and phosphorus, may be employed. The free-machining, austenitic stainless steel of the invention consists essentially of, in weight percent, carbon plus nitrogen both present having a total of up to about 0.065, preferably up to about 0.040 or 0.056; chromium 16 to 30, preferably 17 to 19; nickel 5 to 26, preferably 6 to 14, more preferably 6.5 to 10; sulfur 0.10 to 0.45, preferably 0.10 to 0.25, more preferably 0.25 to 0.45; manganese 0.75 to 2.00; silicon up to about 1; phosphorus up to about 0.20; molybdenum up to about 1.00; up to 1.00 copper; balance iron and incidental impurities.

EXAMPLES

To demonstrate the invention, ten heats of austenitic stainless steel were melted to the chemical compositions, in percent by weight, listed in Table I. The heats were cast into 50-pound ingots which were subsequently heated to 2250° F., forged to 1-3/16-inch hexagonal bars, and annealed for ½ hour at 1950° F., water quenched, and lathe turned to one-inch round bars.

TABLE I

| | Chemical Composition of Laboratory Heats | | | | | | | | | | |
|---|---|---|---|---|---|---|---|---|---|---|---|
| | Weight Percent | | | | | | | | | | |
| Heat | C | Mn | P | S | Si | Ni | Cr | Mo | Cu | N | C + N |
| V548A | 0.005 | 1.59 | 0.028 | 0.31 | 0.63 | 8.66 | 17.34 | 0.35 | 0.28 | 0.002 | 0.007 |
| V569 | 0.021 | 1.61 | 0.035 | 0.33 | 0.65 | 8.74 | 17.58 | 0.35 | 0.28 | 0.017 | 0.038 |
| V464A | 0.019 | 1.57 | 0.030 | 0.32 | 0.61 | 8.61 | 17.43 | 0.37 | 0.28 | 0.021 | 0.040 |
| V468 | 0.019 | 1.55 | 0.028 | 0.30 | 0.45 | 8.50 | 17.52 | 0.35 | 0.27 | 0.037 | 0.056 |
| V470 | 0.023 | 1.56 | 0.030 | 0.31 | 0.68 | 8.62 | 17.54 | 0.35 | 0.27 | 0.041 | 0.064 |
| V464 | 0.021 | 1.50 | 0.029 | 0.32 | 0.63 | 8.61 | 17.53 | 0.35 | 0.28 | 0.044 | 0.065 |
| V465 | 0.018 | 1.50 | 0.028 | 0.33 | 0.61 | 8.59 | 17.53 | 0.35 | 0.28 | 0.053 | 0.071 |
| V559A | 0.066 | 1.58 | 0.032 | 0.32 | 0.67 | 8.59 | 17.88 | 0.35 | 0.27 | 0.013 | 0.079 |
| V466 | 0.037 | 1.54 | 0.027 | 0.31 | 0.64 | 8.62 | 17.65 | 0.35 | 0.29 | 0.045 | 0.082 |
| V557 | 0.025 | 1.61 | 0.029 | 0.34 | 0.64 | 8.56 | 17.64 | 0.35 | 0.28 | 0.062 | 0.087 |

Metallographic evaluations were conducted on specimens from the bars that represent the mid-length of the ingot for each heat. No ferrite was detected in the specimens using either magnetic or metallographic techniques. The microstructures of all the heats were similar with evenly distributed manganese-rich sulfide inclusions.

TABLE II

| | Drill Machinability Evaluation of Laboratory Heats | | | |
|---|---|---|---|---|
| Heat | Composition | | | Drill Machinability |
| Number | % C | % N | % C + N | Rating (DMR)* |
| V548A | 0.005 | 0.002 | 0.007 | 114 |
| V569 | 0.021 | 0.017 | 0.038 | 111 |
| V464A | 0.019 | 0.021 | 0.040 | 110 |
| V468 | 0.019 | 0.037 | 0.056 | 107 |
| V470 | 0.023 | 0.041 | 0.064 | 104 |
| V464 | 0.021 | 0.044 | 0.065 | 103 |
| V465 | 0.018 | 0.053 | 0.071 | 101 |
| V559A | 0.066 | 0.013 | 0.079 | 99 |
| V466 | 0.037 | 0.045 | 0.082 | 100** |
| V557 | 0.025 | 0.062 | 0.087 | 99 |

$$*DMR = \frac{\text{Total Drill Time Standard}}{\text{Total Drill Time Test}} \times 100$$

**Drill Standard

Testing Parameters

Load: 14 pounds

Speed: 320 rpm

Drills: ¼ inch high speed steel jobber bits

Holes: 0.10 inch break-in; 0.30 inch timed depth.

Drill machinability testing was conducted on four-inch long, parallel ground samples from each bar. Table II lists the conditions used for the drill tests, and the drill test results for each laboratory heat. Heat V466 having a carbon plus nitrogen content at about the level found in currently produced resulfurized free-machining austenitic stainless steels was chosen as the standard material and assigned a drill machinability rating of 100. Thus, drill machinability ratings of greater than 100 indicate improved machinability compared to Heat V466, whereas values less than 100 indicate poorer machinability. As may be seen from the drill test results, lowering the carbon plus nitrogen content from 0.082%, the amount normally present in current resulfurized free-machining austenitic stainless steels, to lower levels results in significantly higher drill machinability ratings, indicating improved machinability. An improvement of about 10% is achieved, in going from about 0.08% carbon plus nitrogen with Heat V466 to about 0.04%, as with both Heats V464A and V569. Lowering the carbon and nitrogen still another incremental amount to about the 0.007% levl, as with Heat V548A, results in further machinability improvement, but the rate of improvement is not as great as in going from about 0.08 to 0.04% carbon plus nitrogen.

Further analysis of the drill test results indicate that there is a stronger correlation between the carbon plus nitrogen content of the steels and drill machinability than with either carbon or nitrogen alone. For example, a linear regression analysis of the drill test data revealed a correlation coefficient of 0.90 between carbon plus nitrogen and the drill machinability rating; 0.41 for carbon alone; and 0.32 for nitrogen alone; 1.0 indicating a perfect correlation; 0, no correlation. Thus, the control of carbon plus nitrogen content, rather than carbon or nitrogen alone, is essential for obtaining the desired improvements in machinability.

To further demonstrate the invention, one-inch round bars from Heat V466, having a carbon plus nitrogen of 0.082%, an amount of carbon plus nitrogen typical of current resulfurized, free-machining austenitic stainless steels, and Heats V470 and V464A having carbon plus nitrogen contents of 0.064 and 0.040%, respectively, were subjected to lathe tool-life testing to establish the effect of carbon plus nitrogen contents on the machinability of the steels. In the lathe tool-life test, the number of wafers that can be cut from the steel at various machining speeds before catastrophic tool failure occurs is used as a measure of machinability. The greater the number of wafers cut at a given machining speed, the better the machinability. The specific test conditions used were as follows: material being cut was a one-inch diameter bar; the cut-off tools were hardened ¼-inch wide flat AISI M2 high-speed steel; the tool geometry was 14° front clearance, 3° side clearance, 0° top rake and 0° cutting angle; feed rate was 0.002 inches per revolution; and no lubricant was used. Results of the tool-life testing are set forth in Table III.

TABLE III

Average Number of Wafer Cuts Before Tool Failure in the Plunge-Cut Lathe Turning Test of Laboratory Heats

| Heat Number | % C + N | Machining Speed (Surface Feet/Minute) 160 | 150 | 140 | 130 | 120 | 110 |
|---|---|---|---|---|---|---|---|
| V464A | 0.040 | 4 | 7 | 13 | 14 | — | — |
| V470 | 0.064 | — | 5 | 6 | 10 | 25 | 39 |
| V466 | 0.082 | — | 3 | 3 | 6 | 10 | 15 |

As may be seen from the data presented in Table III, low carbon plus nitrogen contents in accordance with the limits of the invention result in substantial improvements in machinability at machining speeds of 130 to 150 surface feet per minute (sfm). For example, Heat number V466 having 0.082% carbon plus nitrogen provided 6 wafer cuts at 130 sfm; whereas when the carbon plus nitrogen content was reduced below this limit a significant improvement in machinability resulted. With Heat V470, containing 0.064% carbon plus nitrogen, 10 cuts or 67% more wafer cuts were obtained before tool failure. With still further reductions in carbon plus nitrogen content, as with Heat lV464A at 0.040%, the number of wafer cuts doubled as compared to those obtained with the steel containing 0.082% carbon plus nitrogen.

As is well known, the corrosion resistance as well as the machinability of the resulfurized free-machining stainless steels are highly dependent on sulfur content. At least 0.10% sulfur is required in the invention steels to provide significant machinability improvements over those steels containing less than 0.10% sulfur or those steels that are not resulfurized. At sulfur contents in excess of about 0.45%, corrosion resistance is significantly degraded, and the resulting surface finish of the machined part is often degraded. Thus, in applications for the invention steels which require an optimum combination of machinability and corrosion resistance, the sulfur content of the invention steels should be between 0.10 and 0.25%. For those applications requiring maximum productivity of machined parts and where the operating environment is not extremely corrosive, the sulfur content of the steels of the invention should be between 0.25 and 0.45%.

The manganese content of the steels of the invention should be at least 0.75% to assur the formation of manganese-rich sulfides, but not greater than about 2.00% to avoid a reduction in corrosion resistance.

Molybdenum can be added to the steels of this invention to improve corrosion resistance, but should not exceed about 1% because of its detrimental effects on hot workability and machinability.

Copper may be added if desired to improve austenite stability in an amount up to about 1.00%.

What is claimed is:

1. A free-machining, resulfurized, austenitic stainless steel consisting essentially of, in weight percent, carbon plus nitrogen both present having a total of up to 0.065,
chromium: 16 to 30,
nickel: 5 to 26,
sulfur: 0.10 to 0.45,
manganese: 0.75 to 2.00,
silicon: up to about 1,
phosphorus: up to about 0.20,
molybdenum: up to about 1,
copper: up to about 1,
balance iron with incidental impurities.

2. The steel of claim 1 having carbon plus nitrogen up to 0.040.

3. The steel of claim 1 having carbon plus nitrogen up to 0.056.

4. A free-machining, resulfurized austenitic stainless steel consisting essentially of, in weight percent, carbon plus nitrogen both present having a total of up to 0.065.
chromium: 17 to 19,
nickel: 6 to 14,
sulfur: 0.10 to 0.45,
manganese: 0.75 to 2.00,
silicon: up to about 1,
phosphorus: up to about 0.20,
molybdenum: up to about 1,
copper: up to about 1,
balance iron with incidental impurities.

5. The steel of claim 4 having carbon plus nitrogen up to 0.040.

6. The steel of claim 4 having carbon plus nitrogen up to 0.056.

7. The steel of claim 4 having 6.5 to 10 nickel.

8. The steel of claim 7 having carbon plus nitrogen up to 0.040.

9. The steel of claim 7 having carbon plus nitrogen up to 0.056.

10. The steels in claims 1, or 2, or 3, or 4, or 5, or 6, or 7, or 8, or 9 having 0.10 to 0.25 sulfur.

11. The steels in claims 1, or 2, or 3, or 4, or 5, or 6, or 7, or 8, or 9 having 0.25 to 0.45 sulfur.

* * * * *